US005773970A

United States Patent [19]

Dohnal et al.

[11] Patent Number: 5,773,970

[45] Date of Patent: Jun. 30, 1998

[54] TAP CHANGER WITH TICKLER COIL FOR ARCLESS TAP CHANGING

[75] Inventors: Dieter Dohnal, Lappersdorf; Hans-Henning Lessmann-Mieske, Neutraubling, both of Germany

[73] Assignee: Maschinenfabrik Reinhausen GmbH, Regensburg, Germany

[21] Appl. No.: 644,124

[22] Filed: May 10, 1996

[30] Foreign Application Priority Data

May 18, 1995 [DE] Germany ..... 195 18 272.3

[51] Int. Cl.[6] ..... G05F 1/147

[52] U.S. Cl. ..... 323/341; 323/256

[58] Field of Search ..... 323/340, 341, 323/343, 347, 348, 255, 256, 258, 264

[56] References Cited

U.S. PATENT DOCUMENTS

| | | | |
|---|---|---|---|
| 4,081,741 | 3/1978 | Palmer | 323/43.5 R |
| 4,201,938 | 5/1980 | Neumann . | |
| 4,301,489 | 11/1981 | Stich | 361/9 |
| 4,363,060 | 12/1982 | Stich . | |
| 4,550,285 | 10/1985 | Kugler et al. | 323/343 |
| 4,571,499 | 2/1986 | Wein | 323/343 |
| 4,622,513 | 11/1986 | Stich . | |
| 4,904,923 | 2/1990 | Zucker | 323/340 |
| 5,006,784 | 4/1991 | Sonntagbauer | 323/340 |
| 5,128,605 | 7/1992 | Dohnal . | |
| 5,408,171 | 4/1995 | Eitzmann et al. | 323/343 |

FOREIGN PATENT DOCUMENTS 13 99 528 6/1972 United Kingdom .

*Primary Examiner*—Peter S. Wong
*Assistant Examiner*—Derek J. Jardieu
*Attorney, Agent, or Firm*—Herbert Dubno

[57] ABSTRACT

A tap changer in which a pair of selector contacts can be jointly movable or individually movable to engage stationary tap contacts of an array and one of the selector contacts is in series with a tickler coil and switchover resistor connected to one fixed contact of a bypass switch whose movable contact is connected to the load. The other selector contact is connected to one stationary contact of a switchover switch whose movable contact is connected to a second contact of the bypass switch while another contact of the switchover switch is tied to a point between the tickler coil and the resistor. A pair of oppositely poled parallel thyristors bridges the auxiliary network of the tickler coil and resistor and the main branch passing from the switchover switch to the bypass switch. The movable contacts are operated by an intermittent drive of the Geneva mechanism type.

9 Claims, 6 Drawing Sheets

TAP CHANGER WITH TICKLER COIL FOR ARCLESS TAP CHANGING

FIELD OF THE INVENTION

Our present invention relates to a tap changer having a tickler winding or coil, thyristors and a circuit which minimizes the erosion of the selector contacts in a tap changer for transformers and the like.

BACKGROUND OF THE INVENTION

Tap changers which can be operated under load for transformers and the like are described, for example in U.S. Pat. No. 4,622,513. This patent document describes a tap changer for a transformer in which a tickler coil or winding, referred to as a fractional tap voltage auxiliary winding is provided in series with one of the selector contacts. The auxiliary winding is inductively linked to the transformer. That winding, which can be referred to as a tickler winding, can facilitate load switching without arcing at the tap changer selector contacts.

As a general matter it is known to provide tap changer systems with so-called tickler or auxiliary windings and coils which are provided in addition to the usual series winding with its fixed-contact taps selectively engageable by at least one tap selector contact displaceable along the array of the fixed contacts.

The tickler winding or coil is usually so dimensioned that the voltage across it is half of the voltage change per tap change, i.e. half of the voltage difference across successive taps of the transformer. With selective connection of the tickler winding in circuit, the number of possible voltage taps can be doubled.

In the publication "Siemens Energy & Automation Technology" of March 1986, the operation of a tap changer with such a tickler or auxiliary winding for an auto transformer is described. The taps of the normal stepped winding are provided in 1¼% jumps. Through the selective switching of the tickler or auxiliary winding, voltages can be tapped with increments of ⅝%. In an auto transformer of this type, the control range of voltage between ±10% can be achieved in 32 steps, each differing from an adjoining step by ⅝%.

Another tap changer is described in U.S. Pat. No. 4,363,060 which provides, instead of a fixed current limiting resistance, a further switching element which can selectively be connected with one of the taps.

Returning to U.S. Pat. No. 4,622,513 which has been mentioned above, it can be seen that efforts at reducing scaling from arcing have required the presence in both the main and auxiliary circuits of antiparallel thyristor pairs of circuit elements to protect the thyristors from excessively high voltage but yet which will permit firing of the thyristors when a predetermined threshold of the control system is exceeded. In this tap changer, the tickler winding is in series with a resistor which, in turn, is electrically connected with one of the antiparallel thyristor pairs.

All of the aforedescribed tap changers have, however, the drawback in common that if arc scaling in the auxiliary circuit contacts is to be avoided, two separate switching elements equivalent to or including two antiparallel thyristor pairs are required, thereby making the cost of the system comparatively high. Since the circuitry for firing the thyristors, as described in U.S. Pat. No. 4,363,060, is comparatively expensive, the presence of additional pairs of antiparallel thyristors can increase the cost of the system well beyond the cost of the extra thyristor pair itself.

OBJECTS OF THE INVENTION

It is the principal object of the present invention to provide an improved tap changer which can have a minimum number of components, especially thyristors, is more reliable than earlier circuitry for the same purpose and is less expensive.

Another object of the invention is to provide a relatively simple, highly effective, long-lived tap changer which will be free from drawbacks of earlier tap changer systems.

SUMMARY OF THE INVENTION

These objects and others which will become apparent hereinafter are attained, in accordance with the invention, in a tap changer, especially for a transformer, which comprises:

an array of fixed contacts each corresponding to a connectable tap;

a first and a second movable tap selector contact displaceable along the array;

a tickler coil and a switchover resistor in series with a first of the tap selector contacts and forming a series network therewith;

a bypass switch having a pair of selectable bypass contacts and a bypass selector contact connectable to a load, a first of the selectable bypass contacts being connected to the series network;

a switchover switch having a pair of selectable switchover contacts and a switchover selector contact, a first of the selectable switchover contacts being connected to the second tap selector contact, a second of the selectable switchover contacts being connected to the network between the tickler coil and the switchover resistor, the switchover selector contact being connected to a second of the selectable bypass contacts;

a thyristor pair of oppositely poled parallel thyristors connected across a first point between the switchover resistor and the first of the selectable bypass contacts and a second point between the switchover selector contact and the second selectable bypass contact; and a rotary intermittent drive connected to the tap selector contacts and to the selector contacts of the bypass switch and the switchover switch for actuating same.

According to a highly important feature of the invention, the rotary intermittent drive is a Geneva or Maltese mechanism having a Geneva or Maltese wheel which can be coupled with the selector contacts and a driver whose pins engage in the radial slots of the Geneva or Maltese wheel and are carried by a shaft coupled with the bypass and switchover contacts. The driver may have two pins angularly offset at 90° from one another or a single pin as will be described below.

According to another feature of the invention the first and second selector contacts are rigidly connected together or provided on a common support so that they can be moved together. In still another feature of the invention, in a stationary state, the first and second movable selector contacts can be engaged with the same fixed contact or tap.

The system of the invention has the advantage that it requires only a single thyristor pair and only one further switch, hereinafter referred to as the switchover switch, in addition to the movable selector contacts and the known bypass switch.

Both the bypass switch and switchover switch can be single-pole double-throw switches.

The circuit components for the tap changers of the invention are markedly fewer in number than in earlier tap changers and the actuating system is likewise of a simple but reliable construction. The overall cost of the tap changer by comparison with earlier systems is greatly reduced and reliability increased.

In U.S. Pat. No. 5,128,605, there is described an electric switching system for a tap changer operating with a reactor principle between the main and auxiliary branches and by means of which a bypass contact effects connection to the load line. In this system, however, a vacuum cell is provided as a switching element. This system is not capable of voltage setting in fine stages, nor does it utilize a selectively switchable tickler coil.

The Geneva or Maltese mechanism which can be used can comprise the Maltese or Geneva wheel and a Maltese or Geneva driver which in principle is similar to that of the GB Patent 1,399,528. In this Geneva mechanism the drive shaft actuates the bypass switch directly and carries two Geneva wheel drivers, the Geneva wheels operating the selector contacts. This system operates without a tickler or auxiliary winding or coil so that here as well very fine voltage separation in the tap sequence is not possible.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
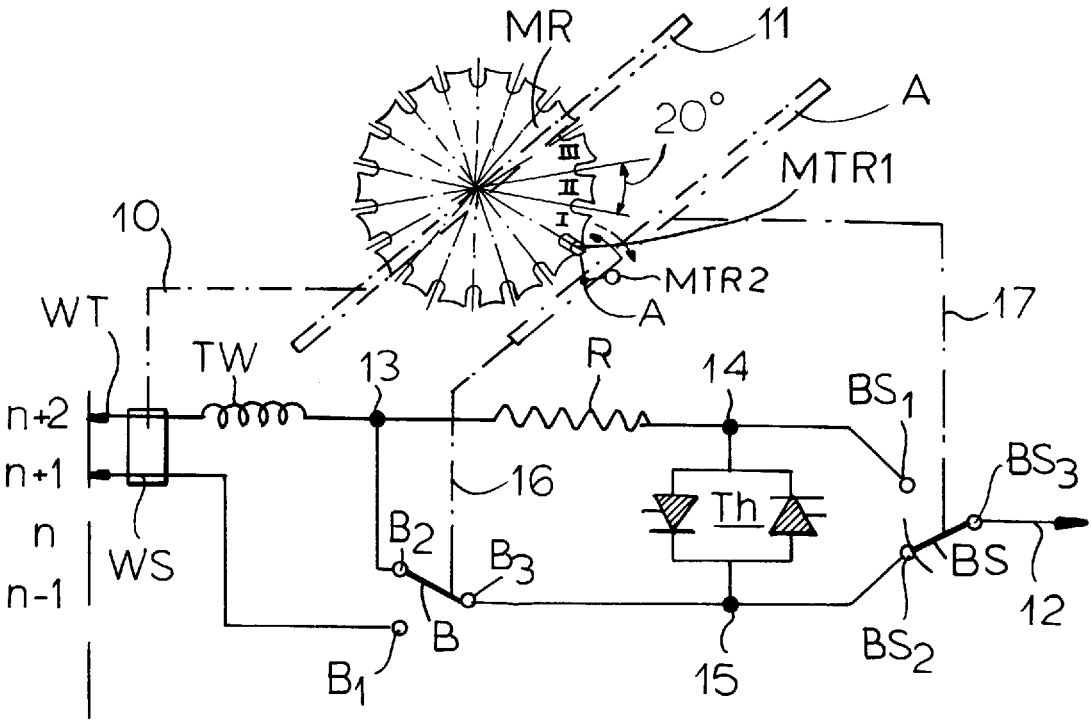
FIG. 1 is a highly schematic illustration of a tap changer in accordance with the invention.

The tap changer shown in FIG. 1 has a plurality of taps for a series winding (not shown) e.g. of a transformer, the fixed contacts or taps being represented at n−1, n, n+1, n+2 . . . These fixed contacts can be engaged by two movable selector contacts WT and WS. The two selector contacts WT and WS are mechanically coupled together so that they can be displaced together.

The fixed contacts have been shown to be in a linear array while the movable contacts WT and WS are shown to be movable linearly along this array. However, in practice the array will be circular and the movable contacts will be shiftable arcuately by connecting them, for example, as shown at 10 to a shaft 11 of a Geneva wheel MR. The Geneva wheel drive will be described in greater detail hereinafter.

The first selector contact WT is connected in series with a tickler coil TW and a resistor R to one of the selectable contacts $BS_1$ of a bypass switch BS whose armature or movable contact $BS_3$ is connected to a load line 12 in circuit with the load. The tickler coil is conductively coupled to the transformer like the auxiliary winding of U.S. Pat. No. 4,622,513.

The second movable contact WS is connected to a first fixed contact $B_1$ of a switchover switch B whose armature or movable contact $B_3$ is connected to the second fixed contact $BS_2$ of the bypass switch BS. The other fixed contact $B_2$ of the switchover switch B is connected at a point 13 between the tickler coil TW and the resistor R to the series network of the tickler coil and resistor. Finally, a pair of antiparallel thyristors Th have their anode and cathode terminals bridged across a point 14 of the series network between the resistor R and the first fixed contact $BS_1$ of the bypass switch BS and a point 15 between the movable contact $B_3$ of the switchover switch B and the second fixed contact $BS_2$ of the bypass switch.

The gates of the thyristors can be triggered by a control circuit as described in U.S. Pat. No. 4,622,513.

As represented by line 16 and line 17, the switches B and BS can be connected to the drive shaft A of the driver for the Geneva wheel MR. In the circuit of FIG. 1, the upper part can be considered to be the auxiliary switching branch while the lower part is the main switching branch. The switchover switch B can selectively connect the tickler winding or coil TW in the main branch.

The pair of thyristors Th have been referred to as antiparallel, meaning that they are poled opposite to one another but connected in parallel as a switching element bridging the main and auxiliary branches. In a stationary state, as shown in FIG. 1, the two movable selector contacts WT and WS both lie on the same fixed contact or tap.

Figure 3:
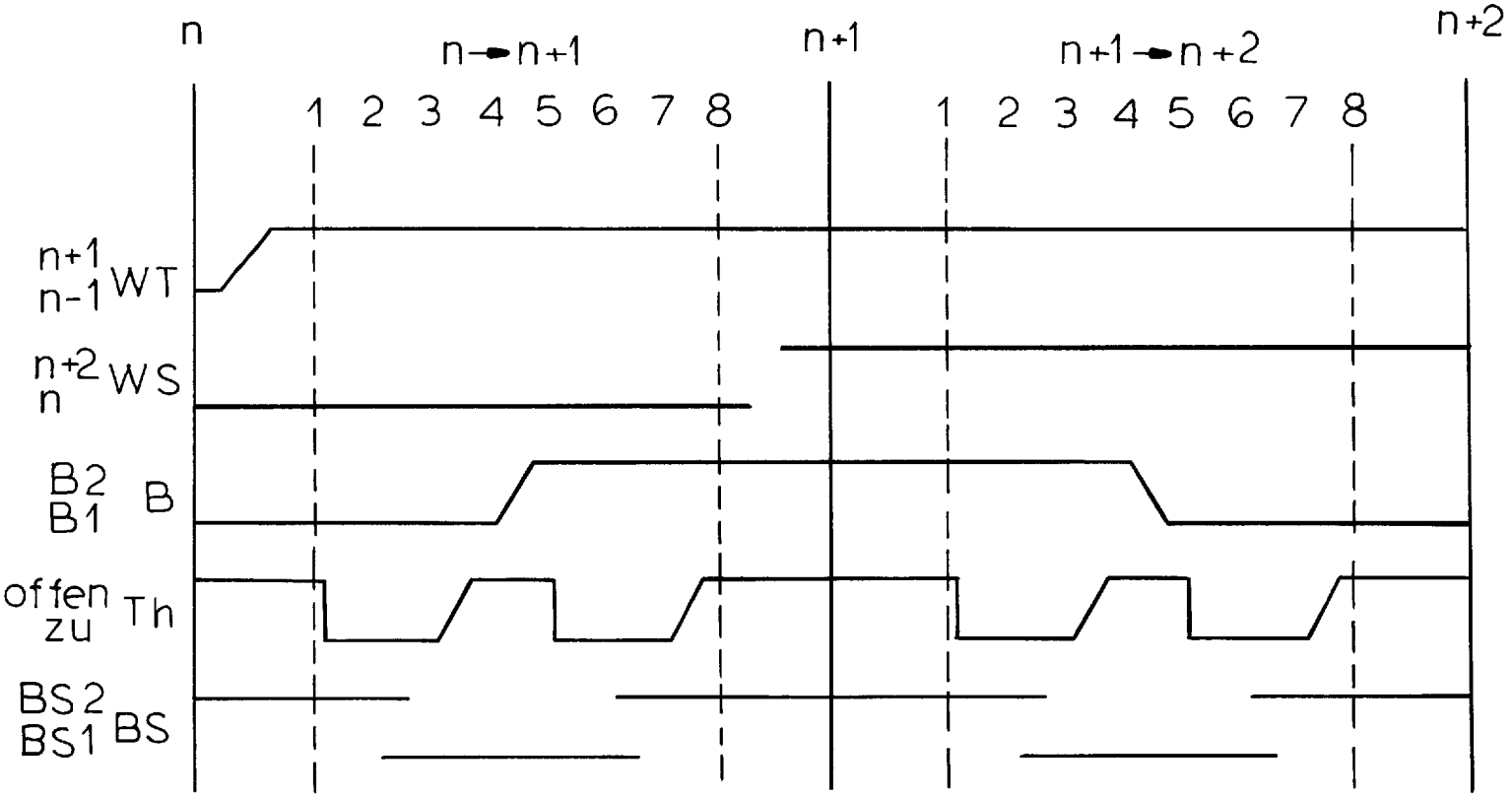
FIG. 3 is a graph showing the switching sequence for the tap changer of FIG. 1.

From FIG. 3 it will be apparent that only with each second switchover will there be a movement of the two movable selector contacts WT, WS. In the intervening switching, only the switch B is actuated, i.e. the tickler winding TW is switched into operation or is not, thereby providing a fine-stage voltage setting. The bypass switch BS as is also apparent from the switching sequence switches without power application and can briefly bridge the contact $BS_1$ and $BS_2$.

Figure 2:
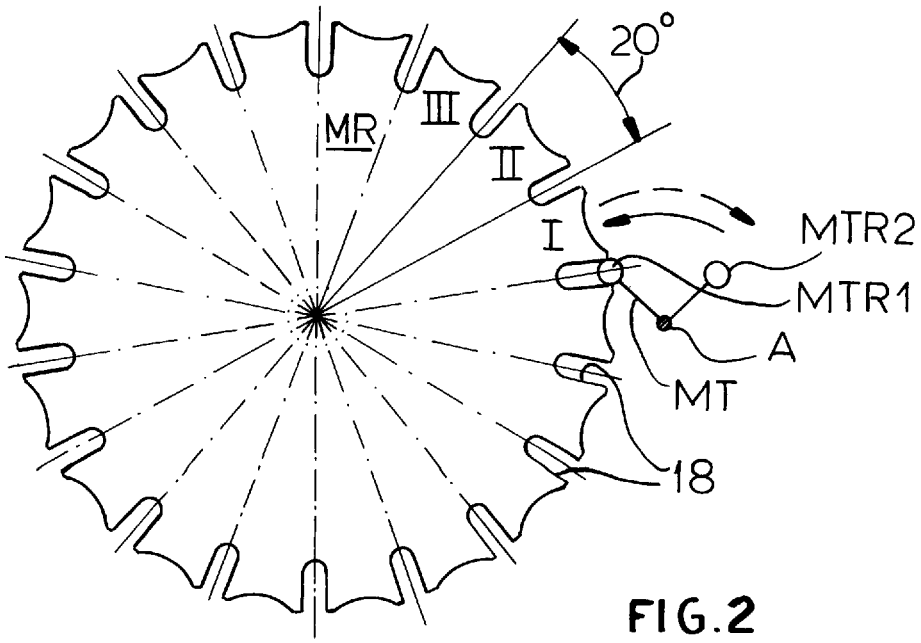
FIG. 2 is an elevational view diagrammatically illustrating the Geneva wheel mechanism for the tap changer of FIG. 1.

The Geneva mechanism which drives the tap changer of FIG. 1 has been illustrated in greater detail in FIG. 2. The Geneva wheel MR diagrammatically shown at the left in this Figure has a 20° spacing of the radial slots. At the right side of this Figure a Geneva driver MT is provided on the drive shaft A. The shaft A rotates 180° per switching of the system. The rollers or pins MTR1 and MTR2 of the driver form an angle of, for example, 90° with respect to the rotation axis of the shaft A and upon engagement in the slots 18, angularly spaced by 20°, will rotate the wheel through 20° until the next engagement of a roller or pin therein.

Figure 2A:
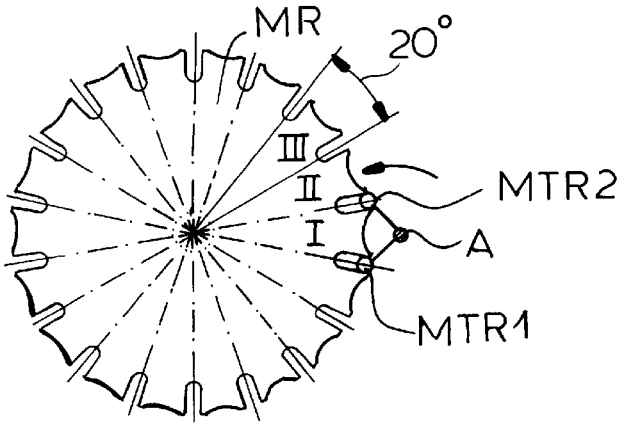
FIGS. 2*a*, 2*b* and 2*c* are views similar to FIG. 2 but drawn to a reduced scale showing successive positions of the Geneva driver and the Geneva wheel.
Figure 2B:
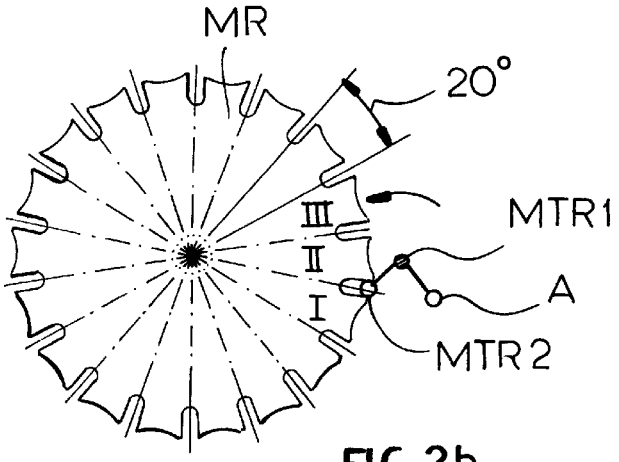
Figure 2C:
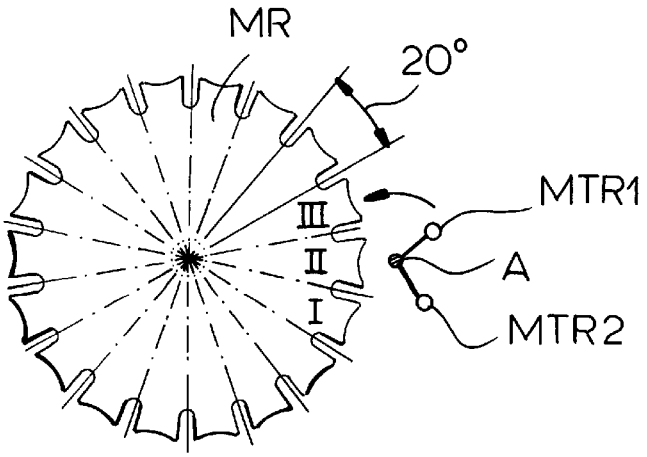

As can be seen from FIGS. 2*a*, 2*b* and 2*c*, from the position shown in FIG. 1, rotation of the shaft A through 180° will step the Geneva wheel through two sectors I and II, each of 20°. The next rotation through 90° (FIG. 2*c*) and the following rotation through 90° returning the pin MTR1 to the position shown in FIG. 2 does not rotate the wheel MR at all. Thus if each switch operation is effected with 180° of rotation of the shaft A, the wheel MR will rotate as the driver rotates through the first 180° and will remain stationary as the driver rotates through the next 180°. The switching operation has been shown with solid line arrow in FIG. 2. FIGS. 2 and 2*b* show end positions of the Geneva driver MTR1, MTR2, while FIGS. 2*a* and 2*c* show intermediate positions. The broken line arrow shows a reverse switching of the taps, e.g. from n to n+1.

The sequence in terms of the movement of the Geneva wheel MR is thus as follows:

For the first load switchover in one direction: 20°-load switching-20°.

Next load switching in this direction: 0°-load switching-0°.

In the stationary state the two rigidly connected movable selector contacts WT and WS are engaged with the same fixed contact n−1, n, n+1, n+2 . . .

Figure 4:
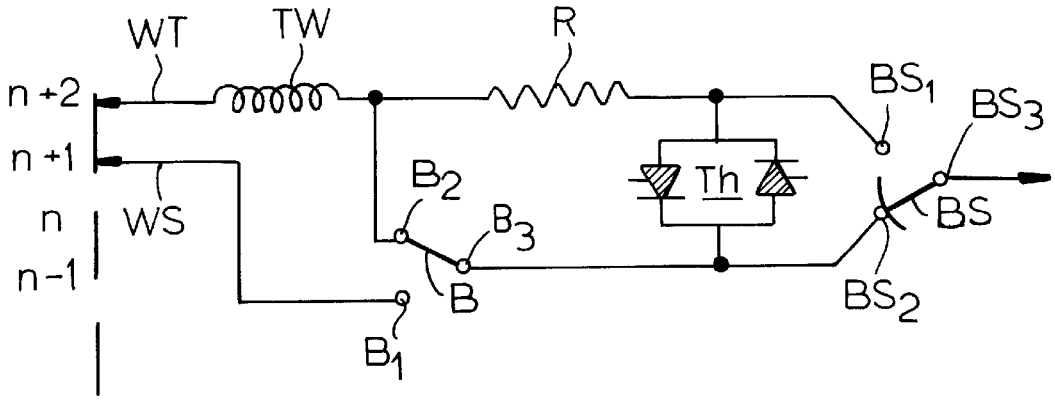
FIG. 4 is a diagram similar to FIG. 1 of another tap changer.
Figure 5:
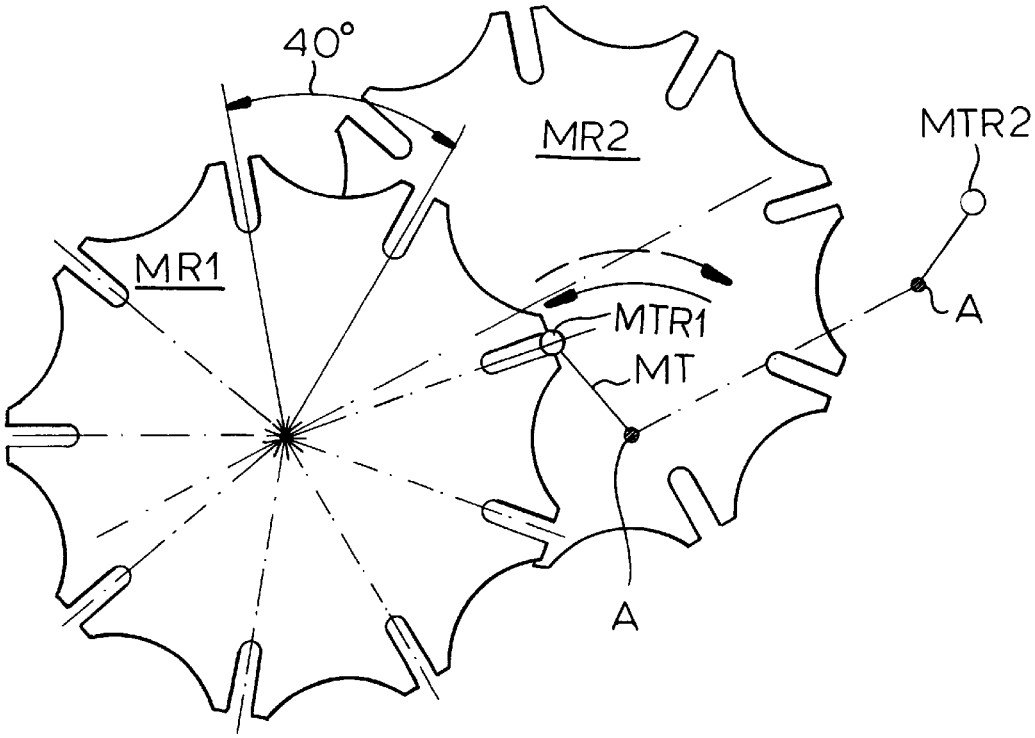
FIG. 5 is a view similar to FIG. 2 of the Geneva wheel mechanism for the circuit of FIG. 4.

FIG. 4 shows a modified circuit differing from that of FIG. 1 in that the two movable selector contacts are actuatable independently from one another. In that case, as has been described in connection with FIG. 1, the contacts WT and WS may be coupled to respective Geneva wheels MR1 and MR2. The drive for the selector contacts has been shown diagrammatically in FIG. 5 and in this system the switching is again effected by rotation of the drive shaft A through 180°/switchover. In this case the Geneva mechanism comprises the two concentric but individually rotatable Geneva wheels MR1 and MR2, each of which can have nine segments with each of the wheels being coupled to one of the two movable selector arms.

At the right-hand side of the Figure, one of the Geneva drivers MT is shown in detail with its two rollers MTR1 and MTR2 offset in two planes along the shaft A. For example, the roller MTR1 is engageable in the slots of the wheel MR1 while the roller MTR2 is engageable in the slots of wheel MR2. Each engagement of a roller in the slot with rotation of the shaft A will cause the respective wheel to rotate through an angle of 40°. This embodiment has the advantage that the two movable contacts WT and WS can be disposed one above the other while the fixed contacts can be smaller, thereby improving the breakdown strength of the system. The movement sequence of the Geneva wheel in this embodiment is the following:

In the first load switching in one direction: 40°-load switching-40°.

For the next load switching in this direction: 0°-load switching-0°.

Figure 6:
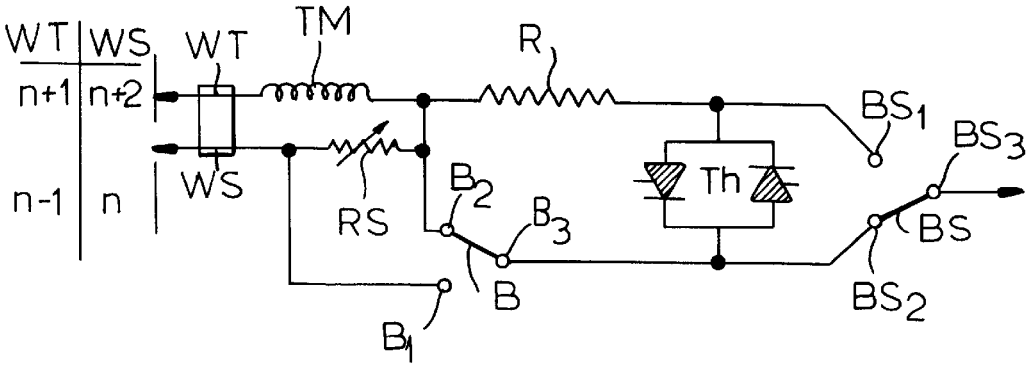
FIG. 6 is a schematic circuit diagram illustrating another tap changer.
Figure 7:
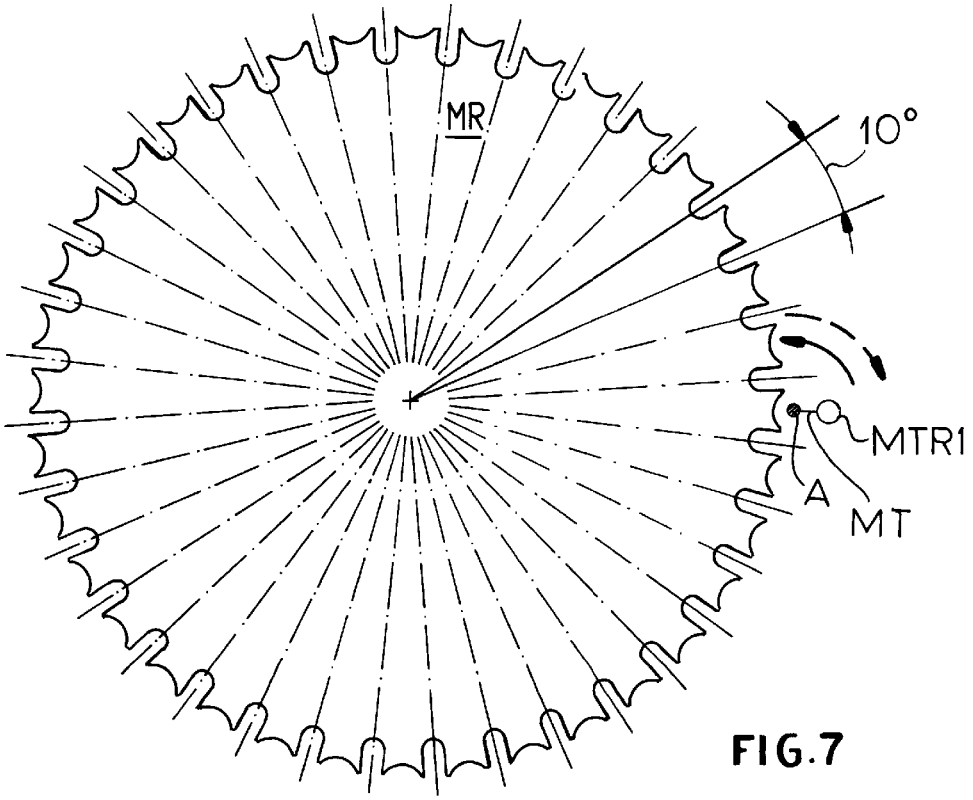
FIG. 7 is another view similar to FIG. 2 but for the tap changer of FIG. 6.

FIG. 6 shows a third embodiment of the tap changer of the invention. Here, once again, the two movable selector contacts WT and WS are rigid with one another and movable together. In this case, however, in the stationary state it is not required that the two contacts each engage a given stationary contact. Rather, only one of the movable contacts engages a stationary contact while the other is disposed in a "neutral" intermediate position as has been shown in the selector contact WS of FIG. 6. In this embodiment it has been found to be advantageous to provide a voltage-dependent resistor RS, for example, a ZnO resistor, in series with the contact WS. This voltage-dependent resistor serves to limit transient voltage spikes which are capacitively transferred otherwise to the movable selector contact WT and would affect the thyristors in their blocking state.

Figure 8:
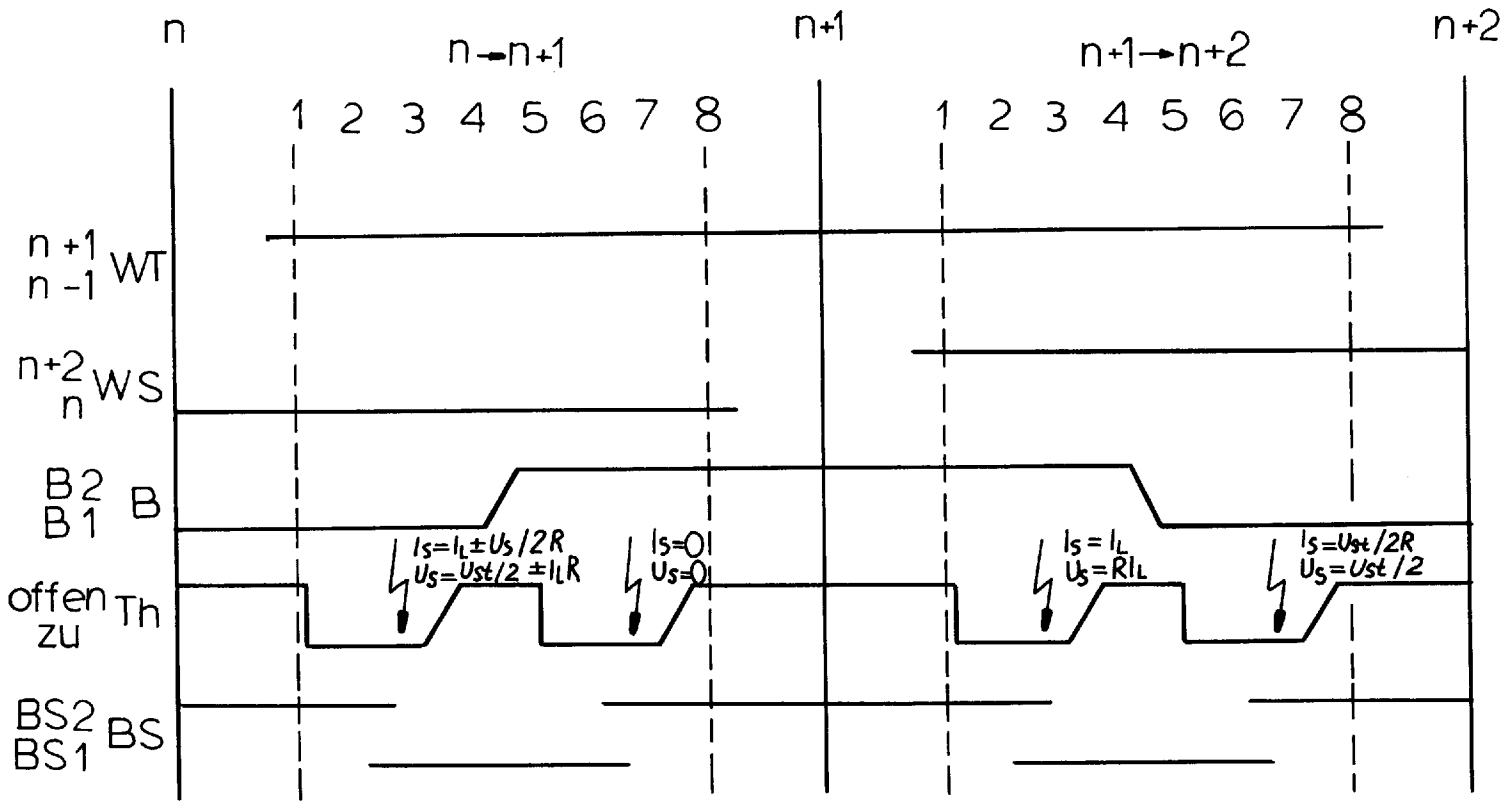
FIG. 8 is a diagram of the switching sequence of the tap changer of FIGS. 6 and 7.

Such a voltage-dependent resistor RS can also be used in the embodiments of FIGS. 1 and 4 if desired. The switching pattern has been shown in FIG. 8 and for the embodiment of FIG. 6 the Geneva wheel MR can have 36 segments and can be operated with a Geneva driver MT with only a single roller MTR1. A rotation of 720° of shaft A per switchover is here used. The operating sequence of the Geneva wheel MR in this embodiment is the following:

For first load switching in one direction: 10°-load switching-10°.

Next load switching in the same direction: 10°-load switching-10°.

In this embodiment with each switching, the selector arms are moved by one increment along the array.

We claim:

1. A tap changer comprising:

an array of fixed contacts each corresponding to a connectable tap;

a first and a second movable tap selector contact displaceable along said array;

a tickler coil and a switchover resistor in series with a first of said tap selector contacts and forming a series network therewith;

a bypass switch having a pair of selectable bypass contacts and a bypass selector contact connectable to a load, a first of said selectable bypass contacts being connected to said series network;

a switchover switch having a pair of selectable switchover contacts and a switchover selector contact, a first of said selectable switchover contacts being connected to said second tap selector contact, a second of said selectable switchover contacts being connected to said network between said tickler coil and said switchover resistor, said switchover selector contact being connected to a second of said selectable bypass contacts;

a thyristor pair of oppositely poled parallel thyristors connected across a first point between said switchover resistor and said first of said selectable bypass contacts and a second point between said switchover selector contact and said second selectable bypass contact; and a rotary intermittent drive connected to said tap selector contacts and to said selector contacts of said bypass switch and said switchover switch for actuating same.

2. The tap changer defined in claim 1 wherein said rotary intermittent drive is a Geneva mechanism.

3. The tap changer defined in claim 2 wherein said Geneva mechanism has a Geneva wheel coupled to at least one of said selector contacts and a Geneva driver on a shaft having a pin engageable with said Geneva wheel.

4. The tap changer defined in claim 3 wherein said selector contacts are connected together for joint movement.

5. The tap changer defined in claim 3 wherein said selector contacts are separately movable, each of said selector contacts being connected to a respective Geneva wheel.

6. The tap changer defined in claim 1 wherein said selector contacts are mechanically coupled together for joint movement.

7. The tap changer defined in claim 6 wherein both of said selector contacts engage a common fixed contact in a stationary state of the tap changing.

8. The tap changer defined in claim 1 wherein both of said selector contacts engage a common fixed contact in a stationary state of the tap changing.

9. The tap changer defined in claim 1, further comprising a voltage-dependent resistor in series with said second selector contact.

* * * * *